US012270396B2

(12) United States Patent
Rosinski

(10) Patent No.: US 12,270,396 B2
(45) Date of Patent: Apr. 8, 2025

(54) ELECTRIC MOTOR WITH DUAL PUMP FOR PROVIDING SCAVENGE AND DELIVERY FUNCTIONS

(71) Applicant: GHSP, INC., Holland, MI (US)

(72) Inventor: Ryan David Rosinski, Whitehall, MI (US)

(73) Assignee: GHSP, Inc., Holland, MI (US)

( * ) Notice: Subject to any disclaimer, the term of this patent is extended or adjusted under 35 U.S.C. 154(b) by 0 days.

(21) Appl. No.: 18/261,689

(22) PCT Filed: Feb. 18, 2022

(86) PCT No.: PCT/IB2022/051472

§ 371 (c)(1),
(2) Date: Jul. 17, 2023

(87) PCT Pub. No.: WO2022/180496

PCT Pub. Date: Sep. 1, 2022

(65) Prior Publication Data

US 2024/0318650 A1 Sep. 26, 2024

Related U.S. Application Data

(60) Provisional application No. 63/153,984, filed on Feb. 26, 2021.

(51) Int. Cl.
*F04D 13/12* (2006.01)
*F04C 2/10* (2006.01)
(Continued)

(52) U.S. Cl.
CPC ..... *F04C 11/006* (2013.01); *F04C 2/10* (2013.01); *F04C 2/3446* (2013.01);
(Continued)

(58) Field of Classification Search
CPC ..... F04C 11/006; F04C 11/005; F04C 11/00; F04C 2/10; F04C 23/00; F04C 23/005; F04C 23/006; F04D 13/12
See application file for complete search history.

(56) References Cited

U.S. PATENT DOCUMENTS 3,335,944 A * 8/1967 Conde ..... F01C 21/104 418/47
5,466,131 A 11/1995 Altham et al.
(Continued)

FOREIGN PATENT DOCUMENTS

CA 3124623 A1 7/2020
EP 1553292 A1 7/2005
(Continued)

OTHER PUBLICATIONS

English translation ob WO2006115434 by Espacenet Aug. 1, 2024.*

*Primary Examiner* — Deming Wan
(74) *Attorney, Agent, or Firm* — Price Heneveld LLP

(57) ABSTRACT

A fluid pump includes a housing. A delivery portion includes a delivery pump element disposed within the housing. A return portion includes a return pump element disposed within the housing. A motor is disposed within the housing that drives the delivery pump element and the return pump element via a drive shaft. The delivery portion is configured to deliver fluid from a reservoir to a drive unit. The return pump element is configured to deliver the fluid from a sump assembly of the drive unit to the reservoir.

20 Claims, 18 Drawing Sheets

(51) Int. Cl.

| | |
|---|---|
| ***F04C 2/344*** | (2006.01) |
| ***F04C 11/00*** | (2006.01) |
| ***F04C 15/00*** | (2006.01) |
| ***F04C 23/00*** | (2006.01) |

(52) U.S. Cl.
CPC ..... *F04C 11/005* (2013.01); *F04C 2240/30* (2013.01); *F04C 2240/40* (2013.01)

(56) References Cited

U.S. PATENT DOCUMENTS

| | | | | |
|---|---|---|---|---|
| 6,679,692 | B1 | 1/2004 | Feuling | |
| 2009/0191078 | A1* | 7/2009 | Colombo | F01D 25/20 417/205 |
| 2014/0196447 | A1* | 7/2014 | Takehana | F04C 11/001 60/456 |
| 2016/0281712 | A1* | 9/2016 | Muizelaar | F04C 2/102 |

FOREIGN PATENT DOCUMENTS

| | | | | |
|---|---|---|---|---|
| EP | 2924291 | A2 | 9/2015 | |
| TW | 200407505 | A | 5/2004 | |
| WO | WO-2006115434 | A1 * | 11/2006 | F01C 1/3568 |
| WO | 2018169376 | A1 | 9/2018 | |

* cited by examiner

ELECTRIC MOTOR WITH DUAL PUMP FOR PROVIDING SCAVENGE AND DELIVERY FUNCTIONS

FIELD OF THE DISCLOSURE

The present invention generally relates to fluid pumps, and more specifically, dual-motor fluid pumps that can be used to scavenge fluid from one or more sumps to a reservoir and also deliver the fluid from the reservoir to a mechanical component.

BACKGROUND OF THE DISCLOSURE

Within mechanical assemblies, fluids are typically used for providing lubrication and cooling functions within the assembly. Fluid pumps can be used for delivering this fluid from a reservoir to a separate location to provide the desired function.

SUMMARY OF THE DISCLOSURE

According to one aspect of the present invention, a fluid pump includes a housing. A delivery portion includes a delivery pump element disposed within the housing. A return portion includes a return pump element disposed within the housing. A motor is disposed within the housing that drives the delivery pump element and the return pump element via a drive shaft. The delivery portion is configured to deliver fluid from a reservoir to a drive unit. The return pump element is configured to deliver the fluid from a sump assembly of the drive unit to the reservoir.

According to another aspect of the invention, a fluid pump includes a housing having a motor portion, a delivery portion and a return portion. A motor is disposed within the motor portion. The motor is operably coupled to a drive shaft that extends from the motor and through the delivery portion and the return portion. A delivery pump element is disposed within the delivery portion and coupled with the drive shaft. A return pump element is disposed within the return portion of the housing and coupled with the drive shaft. Operation of the motor drives the delivery pump element and the return pump element via the drive shaft. The delivery pump element is configured to deliver fluid from a reservoir to a drive unit. The return pump element is configured to deliver the fluid from a first sump and a second sump of the drive unit to the reservoir.

According to another aspect of the invention, a fluid pump includes a motor portion, a delivery pump element and a return pump element. A drive shaft extends from the motor to each of the delivery pump element and the return pump element. The motor, the drive shaft, the delivery pump element and the return pump element are contained within a housing. Operation of the motor simultaneously drives the delivery pump element and the return pump element via the drive shaft. The delivery pump element is configured to deliver fluid from a reservoir to a drive unit. The return pump element is configured to deliver the fluid from a sump assembly of the drive unit to the reservoir.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
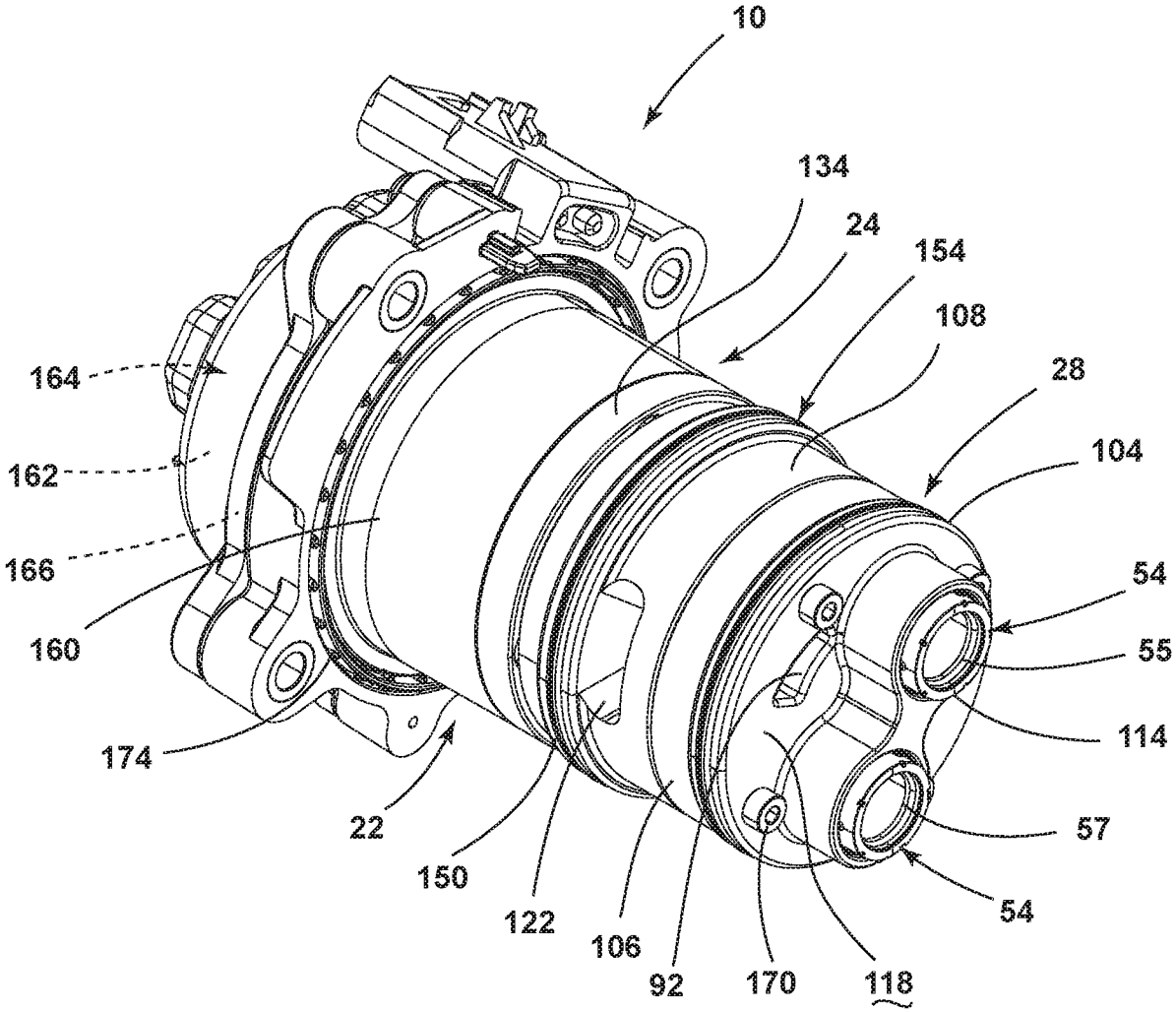
FIG. 1 is a side perspective view of an aspect of the fluid pump.
Figure 2:
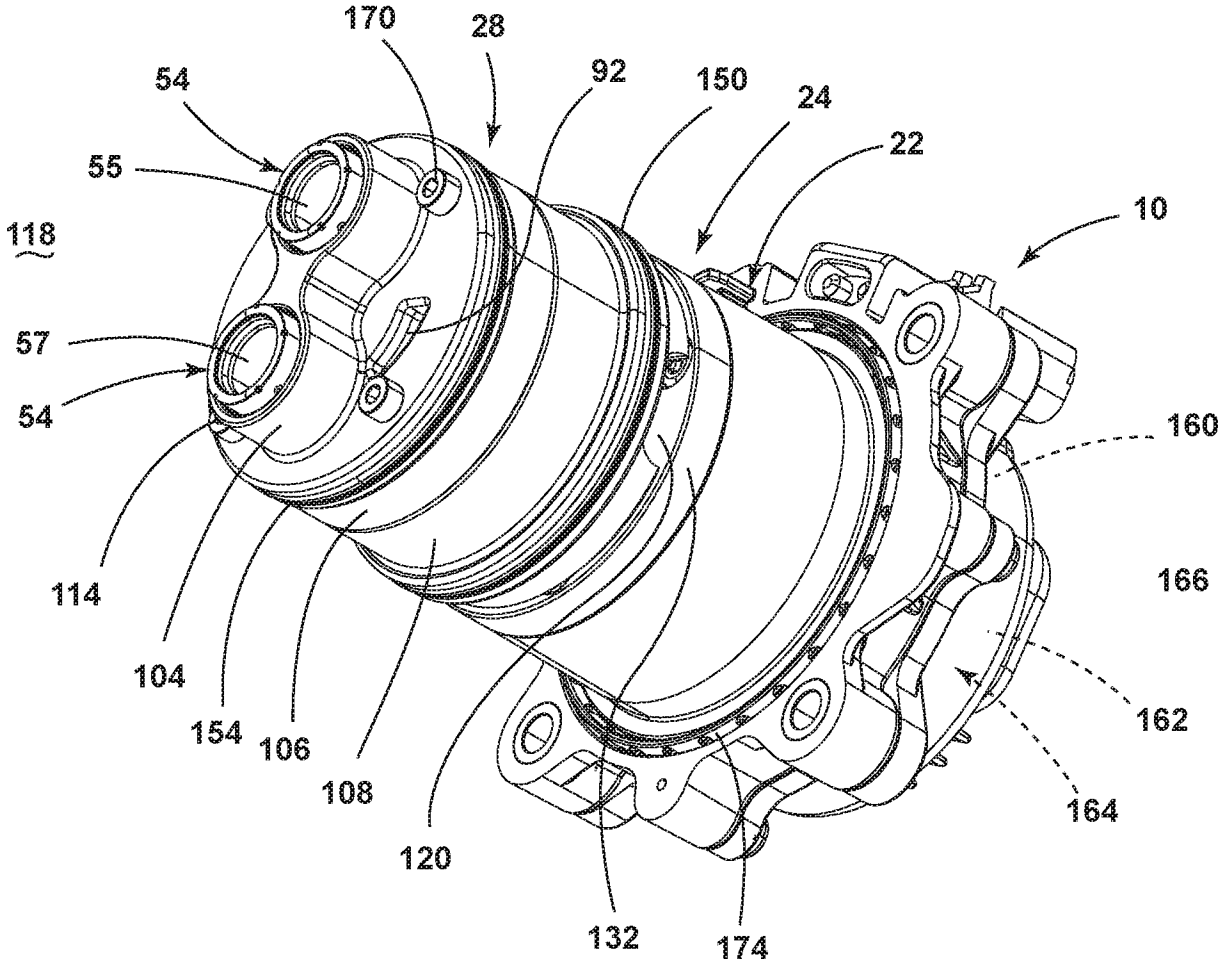
FIG. 2 is another perspective view of the fluid pump of FIG. 1.
Figure 3:
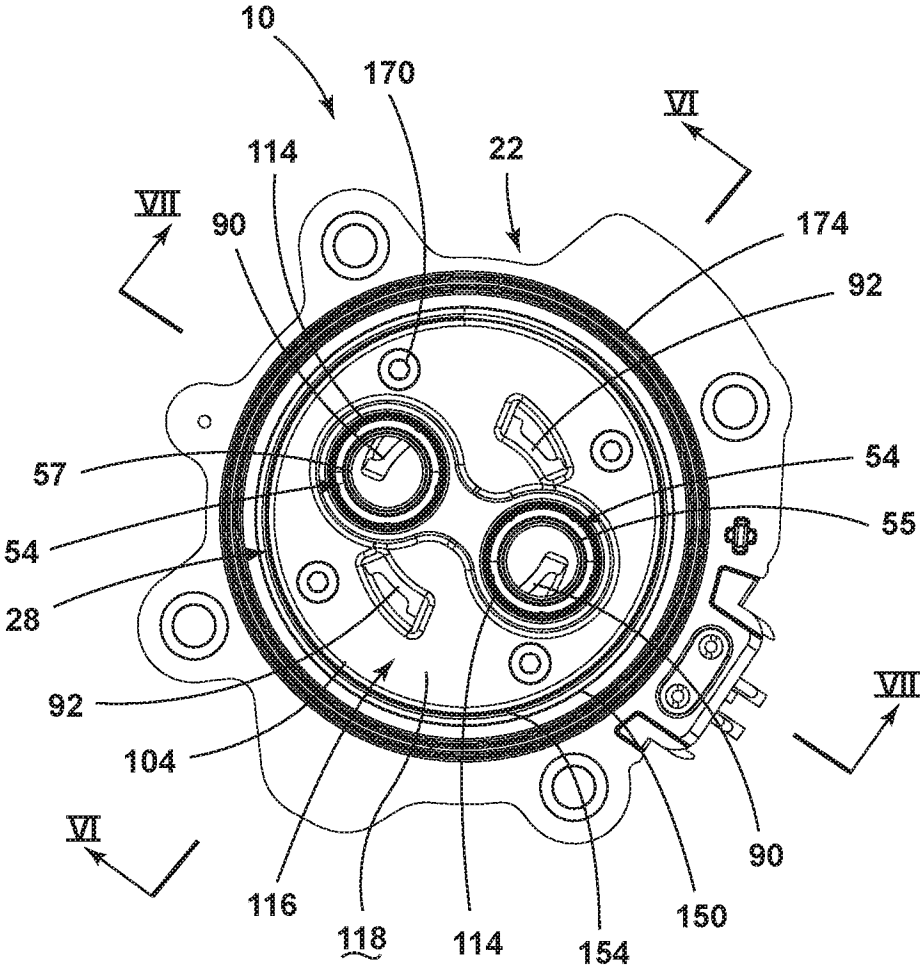
FIG. 3 is an end elevation view of the fluid pump of FIG. 1.
Figure 4:
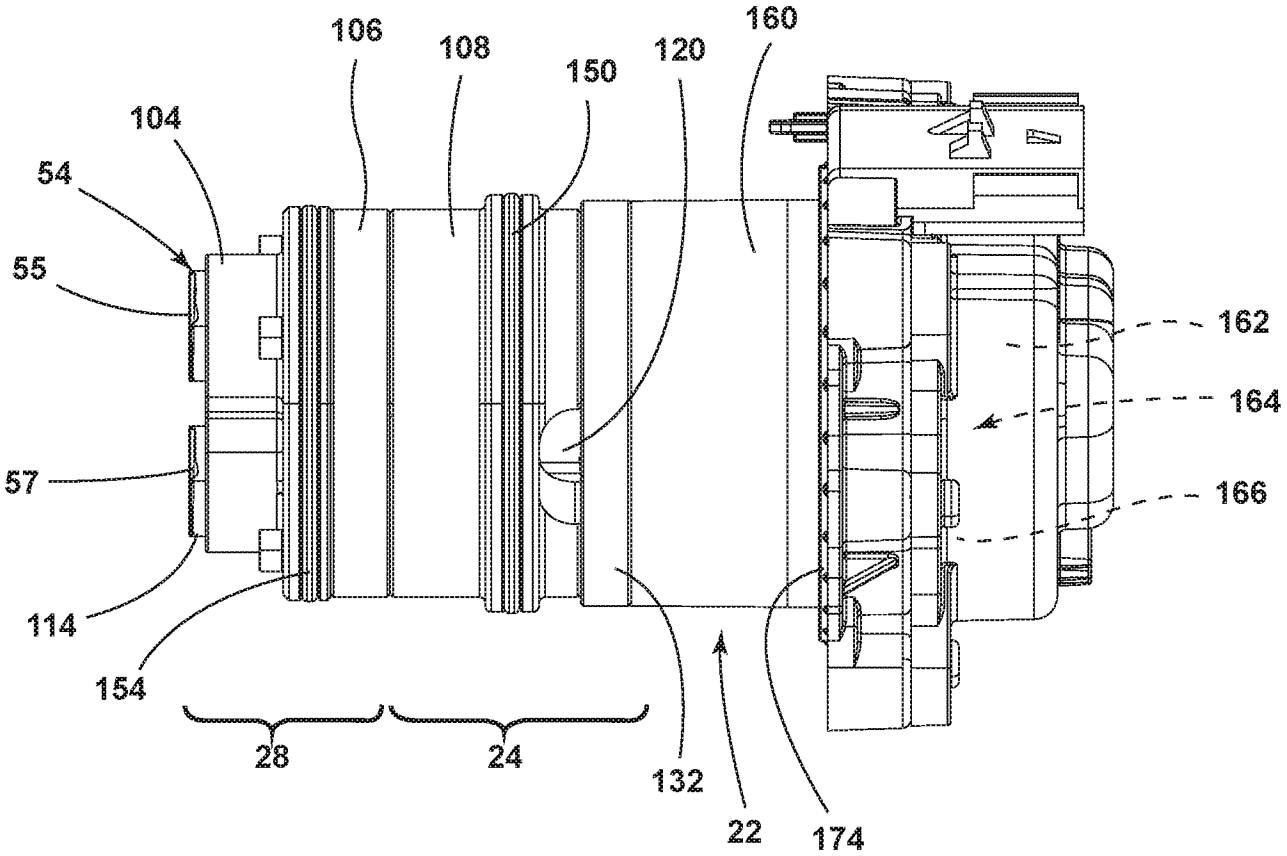
FIG. 4 is a side elevation view of the fluid pump of FIG. 2.
Figure 5:
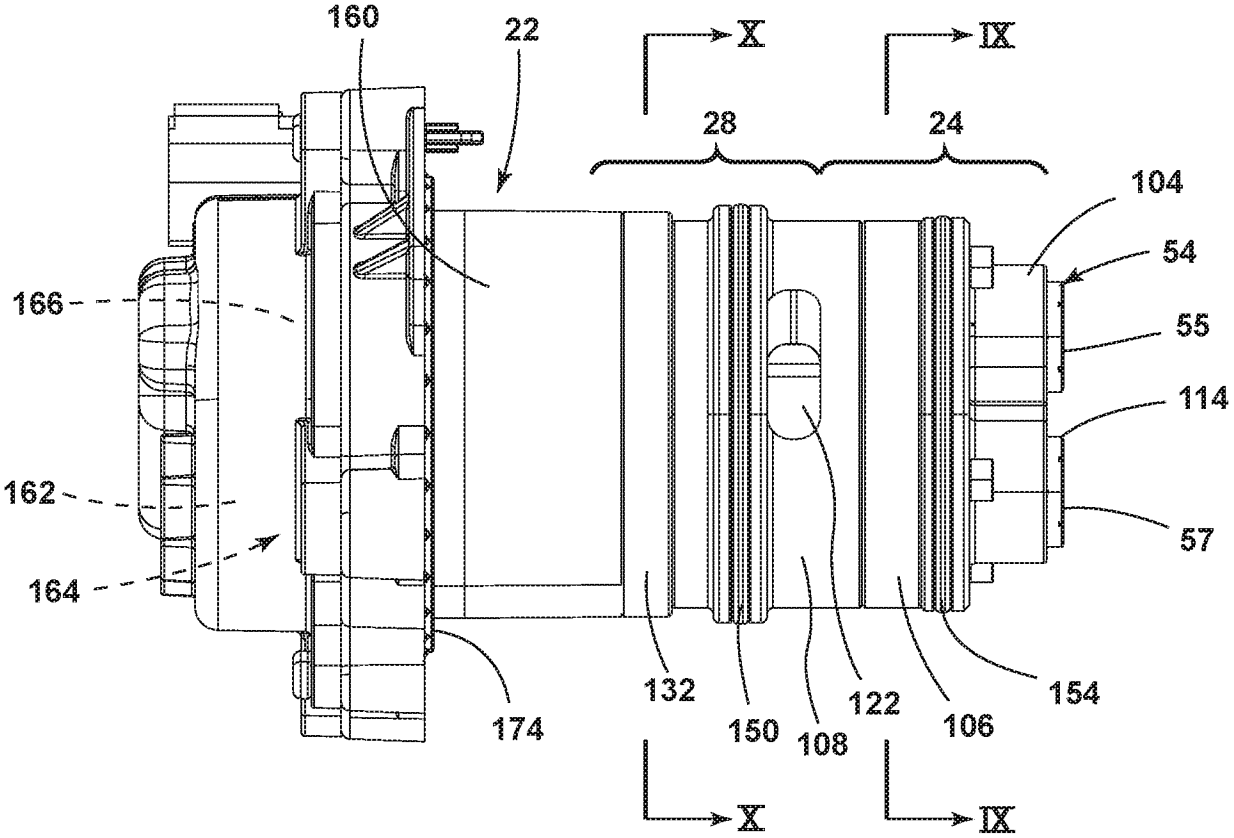
FIG. 5 is a side elevation view of the fluid pump of FIG. 1.

Additional features and advantages of the present disclosure will be set forth in the detailed description which follows and will be apparent to those skilled in the art from the description, or recognized by practicing the invention as described in the following description, together with the claims and appended drawings.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions.

For purposes of this disclosure, the term "coupled" (in all of its forms: couple, coupling, coupled, etc.) generally means the joining of two components (electrical or mechanical) directly or indirectly to one another. Such joining may be stationary or movable in nature. Such joining may be achieved with the two components (electrical or mechanical) and/or any additional intermediate members. Such joining may include members being integrally formed as a single unitary body with one another (i.e., integrally coupled) or may refer to joining of two components. Such joining may be permanent in nature, or may be removable or releasable in nature, unless otherwise stated.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

As exemplified in FIGS. 1-18, reference numeral 10 generally refers to a fluid pump that is incorporated within a mechanical assembly, such as a drive unit 12, for delivering fluid 14 from a sump assembly 15, which can include one sump 16 or a plurality of sumps 16, to a reservoir 18 and then from the reservoir 18 to the drive unit 12 that includes the sump assembly 15. The fluid pump 10 includes multiple pump elements that move the fluid 14 between the various components within a fluid circuit, such as a hydraulic system 20, for the drive unit 12. According to various aspects of the device, the fluid pump 10 includes a housing 22 that is made up of multiple components that are attached together to form the fluid pump 10. A delivery portion 24 of the fluid pump 10 includes a delivery pump element 26 that is disposed within the housing 22. A return portion 28 of the fluid pump 10 includes a return pump element 30 that is also disposed within the housing 22. A motor 32 is disposed within the housing 22 that drives the delivery pump element 26 and the return pump element 30, typically simultaneously, via a drive shaft 34. The delivery portion 24 is configured to deliver fluid 14 from the reservoir 18 to the drive unit 12. The return pump element 30 is configured to deliver the fluid 14 from at least one of the sumps 16 of the drive unit 12 to the reservoir 18, where the fluid 14 can then be delivered using the delivery pump element 26.

Referring to FIGS. 1-18, the drive unit 12 that is cooled or lubricated using the fluid pump 10 can be in the form of a transmission, or other similar mechanical assembly within a particular application, typically vehicular applications. The use of the fluid pump 10 having the delivery portion 24 and the return portion 28 allows the system to maintain a desirable level of the fluid 14 at the drive unit 12. Fluid 14 that may not be needed within the drive unit 12 at that time can be temporarily maintained or stored within the reservoir 18 for later recirculation throughout the hydraulic system 20. By maintaining a desirable level of fluid 14 within the drive unit 12, fluid drag within the drive unit 12 is minimized and the drive unit 12 can be of a smaller overall size or have a lower profile to accommodate the need for lesser amounts of fluid 14 within the sumps 16 of the drive unit 12.

The fluid pump 10 utilizes a single motor 32 for controlling each of the delivery pump element 26 and the return pump element 30. The delivery and return pump elements 26, 30 are integrated together to provide a compact package and weight reduction within the fluid pump 10. As discussed herein, the motor 32 is configured to simultaneously or contemporaneously operate each of the delivery and return pump elements 26, 30 via the drive shaft 34.

Referring again to FIGS. 1-18, the motor 32 that drives the delivery pump element 26 and the return pump element 30 can be an electric motor 32 having a rotor 40 that is in electromagnetic communication with a stator 38. Energizing windings 42 of the stator 38 cause the rotor 40 to rotate about a rotational axis 44. The rotor 40 is attached to the drive shaft 34 that extends through the housing 22 for the fluid pump 10. This drive shaft 34 extends through the delivery portion 24 and the return portion 28 of the housing 22. In this manner, the drive shaft 34 engages with each of the delivery pump element 26 and the return pump element 30 for operating each of these pump elements within the fluid pump 10. In addition, when the motor 32 operates, each of the delivery pump element 26 and the return pump element 30 operate simultaneously to deliver the fluid 14 through the hydraulic system 20 and between the drive unit 12, including the sump assembly 15 therefore, and the reservoir 18.

Referring again to FIGS. 6-18, fluid 14 within the drive unit 12 collects within each of the sump assembly 15 for the drive unit 12. While first and second sumps 50, 52 are shown within FIG. 11, it is contemplated that a single sump 16 or multiple sumps 16 can be included within the sump assembly 15 for a particular drive unit 12. Where multiple sumps 16 are included within the sump assembly 15, the fluid pump 10 can include a separate and dedicated return inlet 54 for each respective sump 16 of the drive unit 12. When the motor 32 for the fluid pump 10 is activated, the return pump element 30 rotates through operation of the drive shaft 34.

Referring now to FIGS. 1-10, it is contemplated that the return pump element 30 can be in the form of a vane pump 60 that operates within an eccentric pump chamber 62. The vane pump 60 includes a rotary member 58 having a plurality of radially-operable and outwardly-biased fins 64 that are biased outward from the rotary member 58 during operation of the motor 32 according to centrifugal force 66. This centrifugal force 66 causes the fins 64 of the vane pump 60 to engage an inner wall 68 of the eccentric pump chamber 62, thereby defining a plurality of operable pump cavities 70. As the return pump element 30 rotates, these operable pump cavities 70 are formed between the cylindrical shape of the rotary member 58 and the elliptical shape of the inner wall 68 of the eccentric pump chamber 62. This configuration causes the pump cavities 70 to expand and contract along with the eccentric shape of the inner wall 68 of the eccentric pump chamber 62. Expansion and contraction of the individual pump cavities 70 generates pressure differences in the form of suction 72 into an expanding pump cavity 74 and expulsion 76 from a contracting pump cavity 78. These changes in pressure within the pump cavities 70 cause the fluid 14 to be drawn into and be expelled from the return pump element 30. Again, the expansion and contraction of the various pump cavities 70 is caused by the eccentric shape of the eccentric pump cavity 74 within which the return pump element 30 operates. In certain aspects of the device, the radially-operable and outwardly-biased fins 64 can include biasing members that bias the fins 64 in an outward direction and into engagement with the inner wall 68 of the eccentric pump chamber 62 to define the operable pump cavities 70.

As exemplified in FIGS. 1-11, the fluid pump 10 includes two return inlets 54, such as a first return inlet 55 and a second return inlet 57, which are commonly referred to as scavenge inlets. The first and second return inlets 55, 57 cooperate with the return pump element 30 to draw fluid 14 from at least one, and typically both, of the first and second sumps 50, 52. Operation of the return pump element 30 moves this fluid 14 from the one or both of the first and second sumps 50, 52 and into the eccentric pump chamber 62 via respective first and second return inlets 55, 57 and the inlet ports 90 and through the eccentric pump chamber 62. The return pump element 30 then operates to move the fluid 14 toward the reservoir 18 via opposing outlet ports 92 of the eccentric pump chamber 62. The fluid 14 is then collected within the reservoir 18 for further recirculation by other components of the fluid pump 10, as will be described more fully below.

Referring again to FIGS. 3-11, the return inlets 54 each extend from a corresponding sump 16 of the drive unit 12 and extend into the eccentric pump chamber 62 via the inlet ports 90 for the return pump element 30. The corresponding outlet ports 92 extend from opposing sides of the eccentric pump chamber 62 and toward the reservoir 18. The opposing outlet ports 92 can be configured to merge together and combine within the return portion 28 of the fluid pump 10 such that a single return outlet 100 is used to deliver the fluid 14 from the eccentric pump chamber 62 and toward the reservoir 18. The return channels 102 that make up the return inlets 54, the inlet ports 90, the outlet ports 92 and the return outlet 100 can be defined within the return portion 28. Typically, these channels are defined within a pump cover 104, an eccentric ring 106 and a porting housing 108 of the fluid pump 10. Using this configuration, the return pump element 30 is able to draw fluid 14 from either of the first and second sumps 50, 52 or both of the first and second sumps 50, 52 for the drive unit 12 for delivery to the reservoir 18. Accordingly, collection of the fluid 14 within any one sump 16 or multiple sumps 16 of the sump assembly 15 will result in fluid 14 being drawn into the eccentric pump chamber 62.

Referring again to FIGS. 3-11, the fluid path between the pair of return inlets 54 to the single return outlet 100 can be defined between the pump cover 104 and the manifold 176 that receives the fluid pump 10. The return inlets 54 can include one gasket or a plurality of gaskets, such as respective spring seals 114, that span across a return flow space 116 that is defined between an end surface 118 of the pump cover 104 and the manifold 176. The return outlet 100 can be in communication with this return flow space 116. In an exemplary operation, the fluid 14 from the first and second sumps 50, 52 moves through the spring seals 114, separated from the flow space 116, then into the eccentric pump chamber 62 via the inlet ports 90 and through the return pump element 30, as described herein. The fluid 14 is then moved out from the eccentric pump chamber 62 via the opposing outlet ports 92 and into the return flow space 116. The fluid 14 is expelled from the eccentric pump chamber 62 and through the return flow space 116 through the operation of the vane pump 60 and the contracting pump cavities 78. This expulsion 76 pushes the fluid 14 through the single return outlet 100 and toward the reservoir 18. Through this configuration, the two return inlets 54 and the return pump element 30 provides the consistent flow of fluid 14 toward the single return outlet 100.

In certain instances, one of the sumps 16 may be dry while the other sump 16 may include a quantity of the fluid 14. In such an instance, the return pump element 30 is able to provide sufficient fluid 14 through the return portion 28 of the fluid pump 10 for delivery of the fluid 14 to the reservoir 18. Through this configuration, a consistent supply of fluid 14 can be delivered from the sumps 16 (one or both of the first and second sumps 50, 52) and to the reservoir 18 for later recirculation through the hydraulic system 20.

Figure 6:
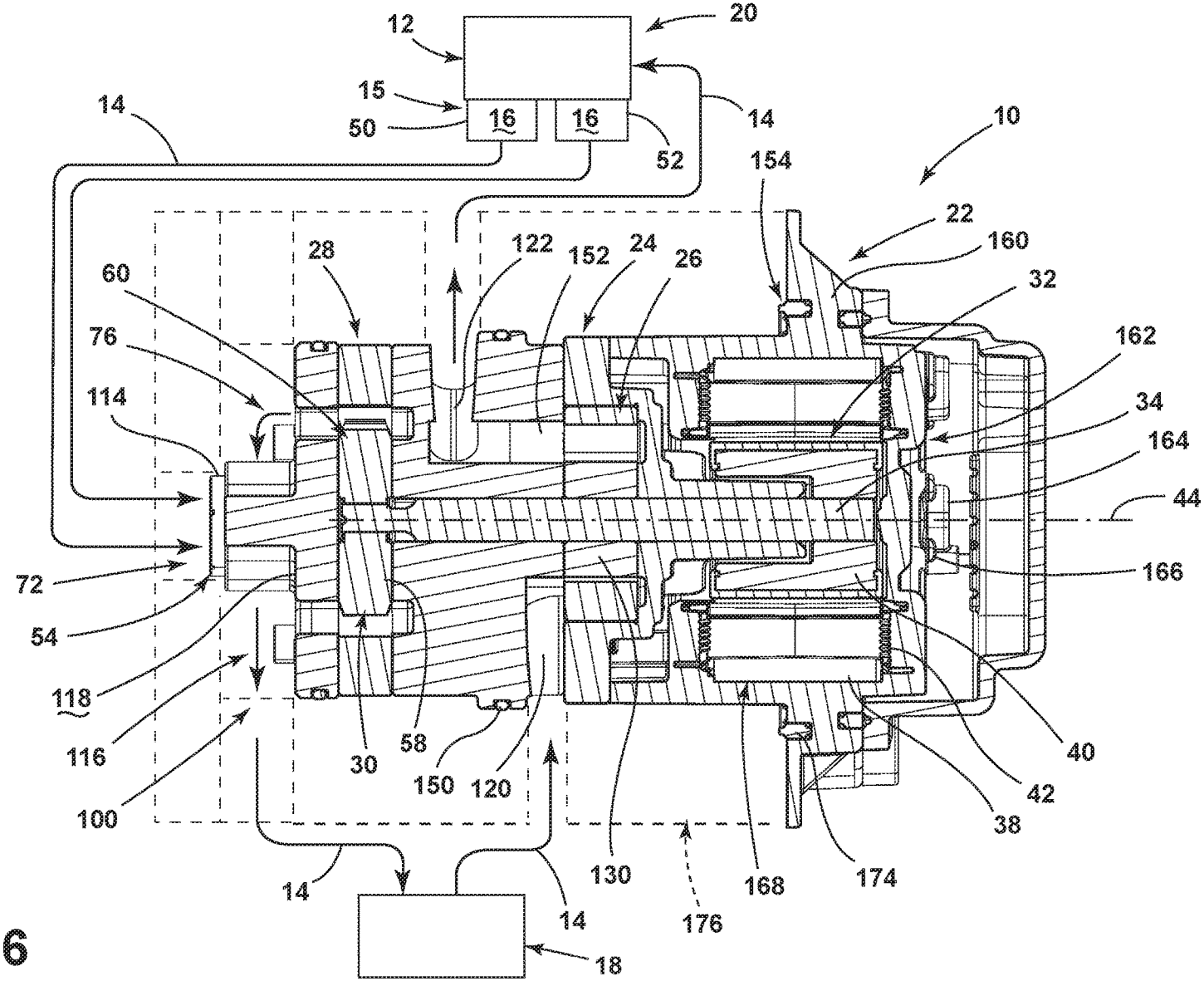
FIG. 6 is a cross-sectional view of the fluid pump of FIG. 3 taken along line VI-VI.
Figure 7:
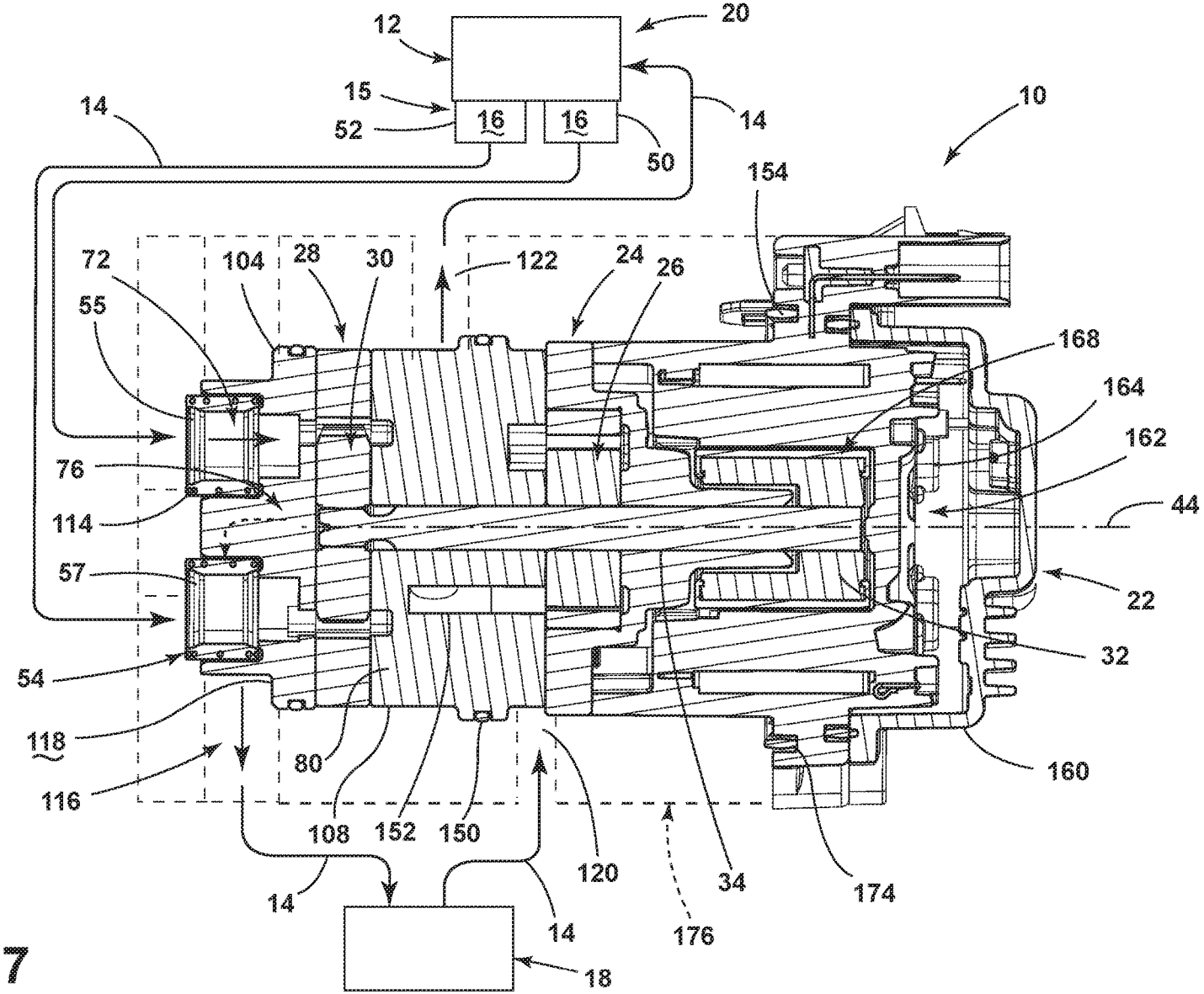
FIG. 7 is a cross-sectional view of the fluid pump of FIG. 3 taken along line VII-VII.
Figure 8:
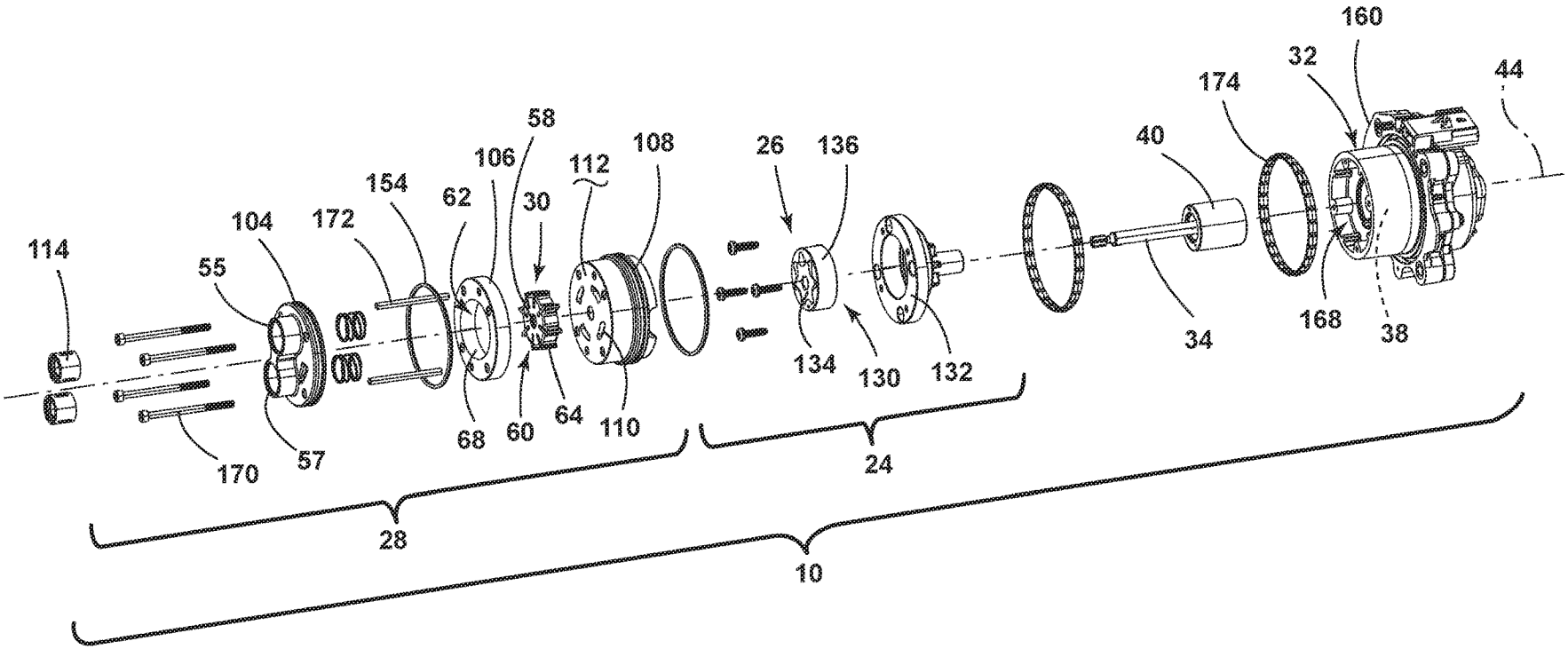
FIG. 8 is an exploded perspective view of the fluid pump of FIG. 2.
Figure 9:
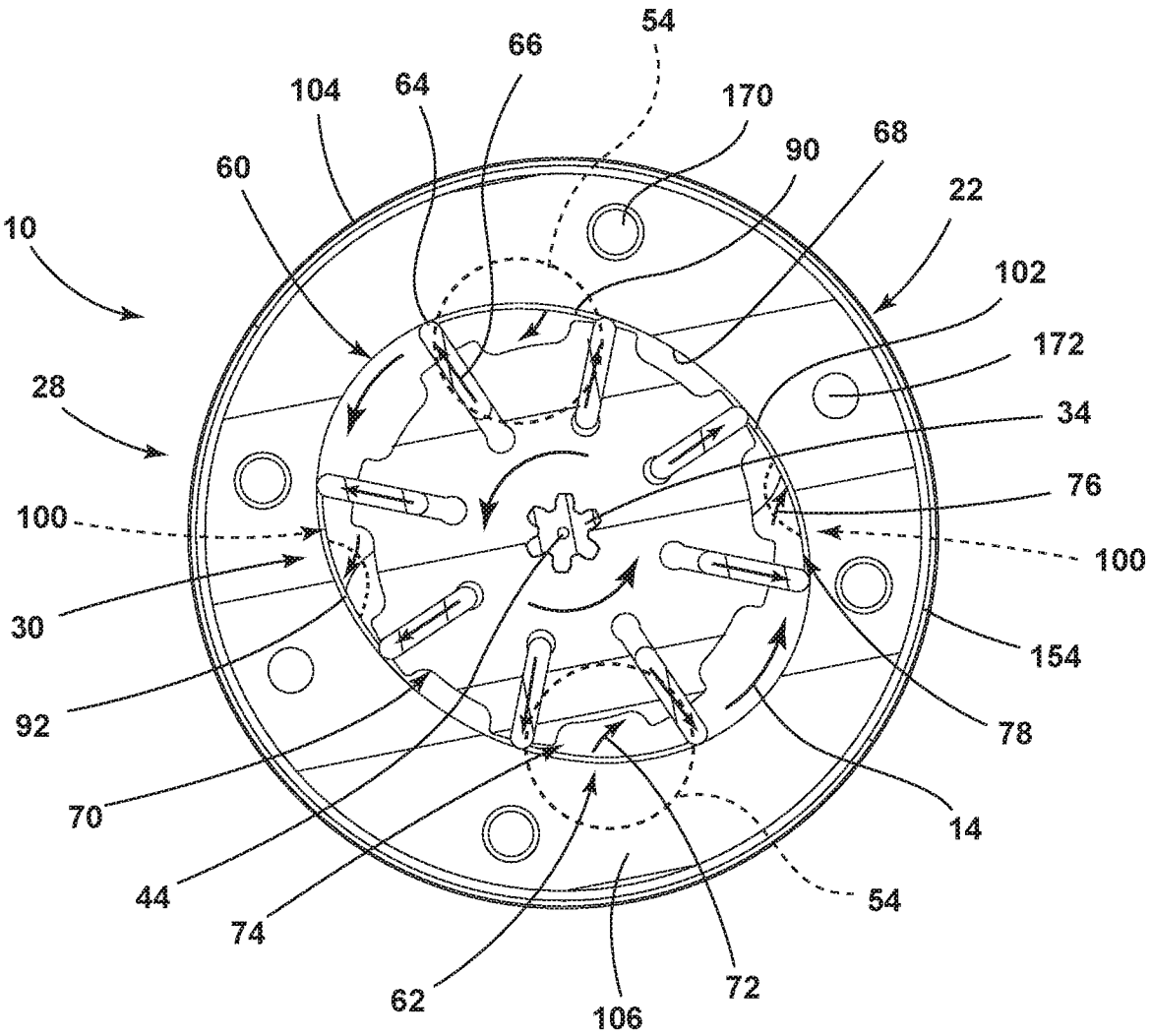
FIG. 9 is a cross-sectional view of the fluid pump of FIG. 5 taken along line IX-IX and showing an aspect of the return pump element.
Figure 10:
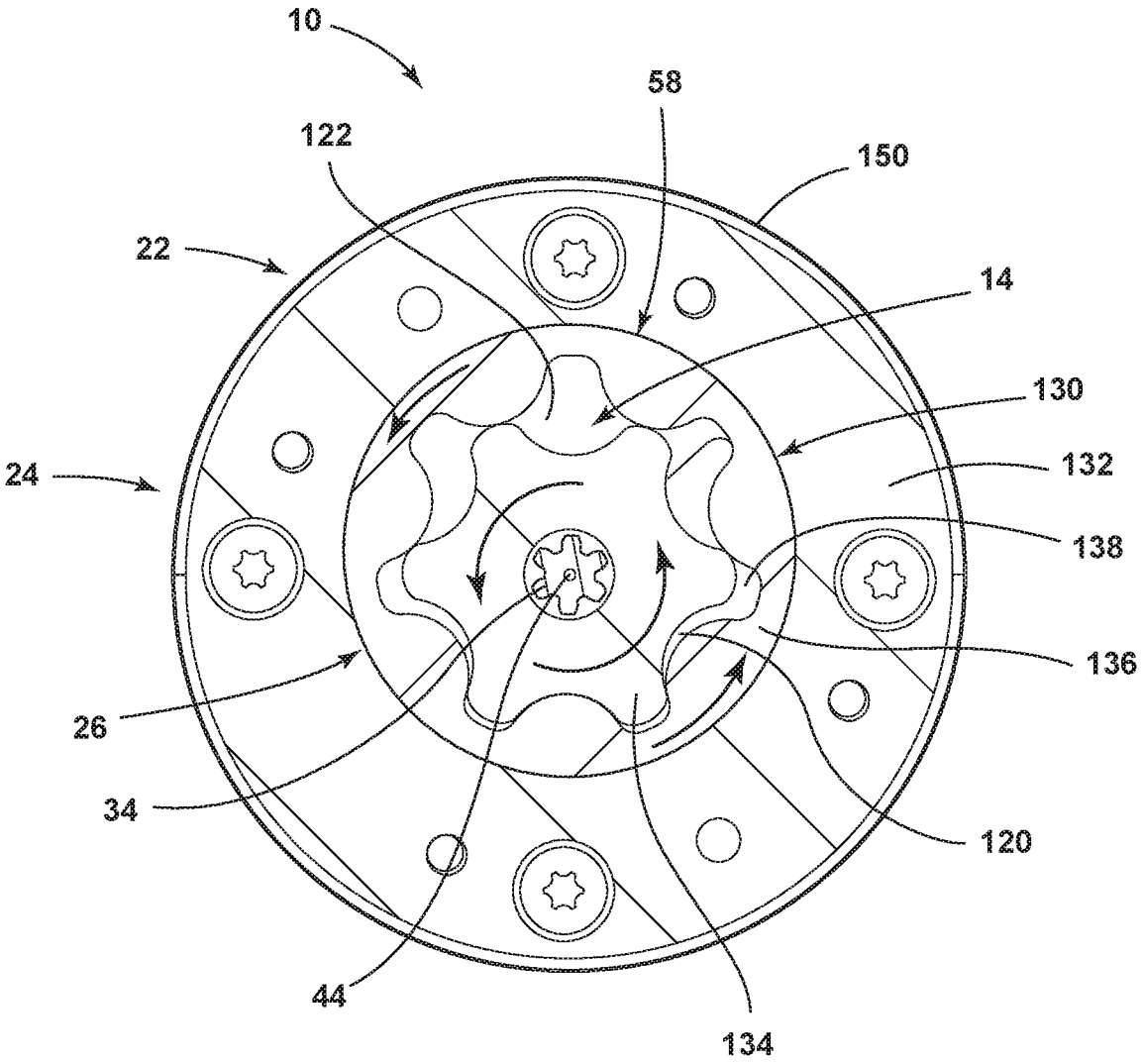
FIG. 10 is a cross-sectional view of the fluid pump of FIG. 5 taken along line X-X and showing an aspect of the delivery pump element.
Figure 11:
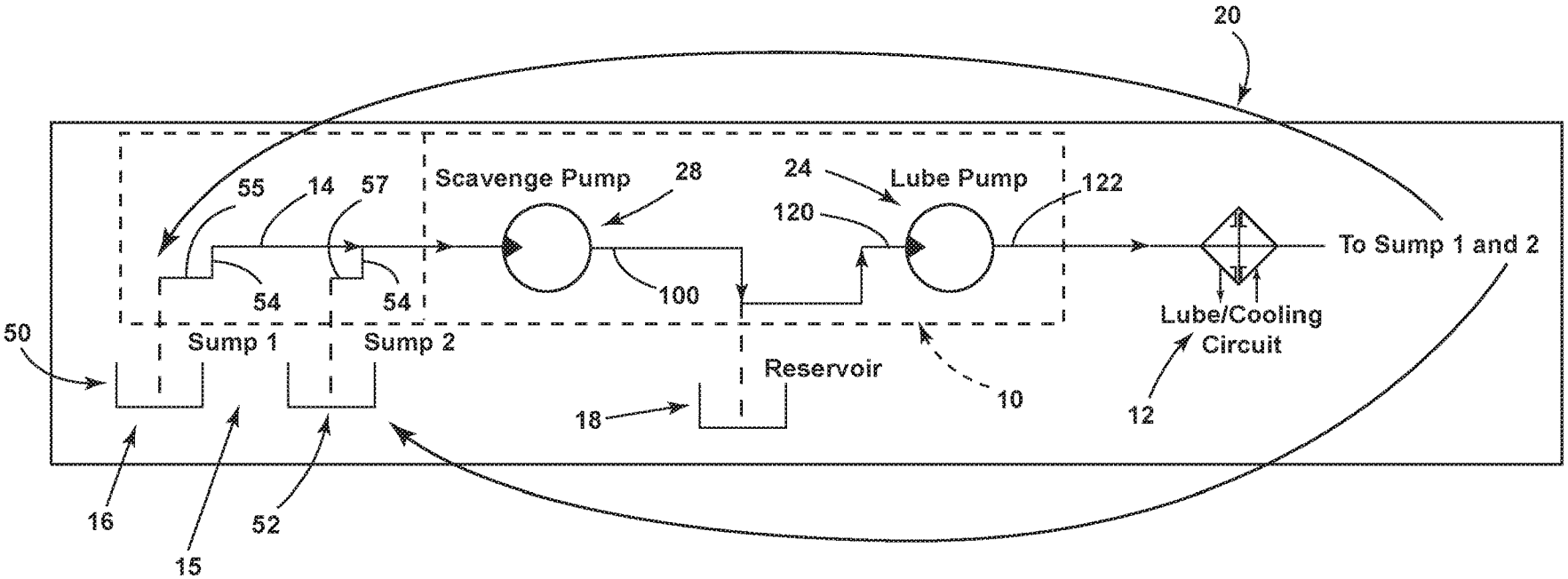
FIG. 11 is a schematic diagram illustrating a flow of fluid through a fluid path using an aspect of a fluid pump of FIG. 1.
Figure 12:
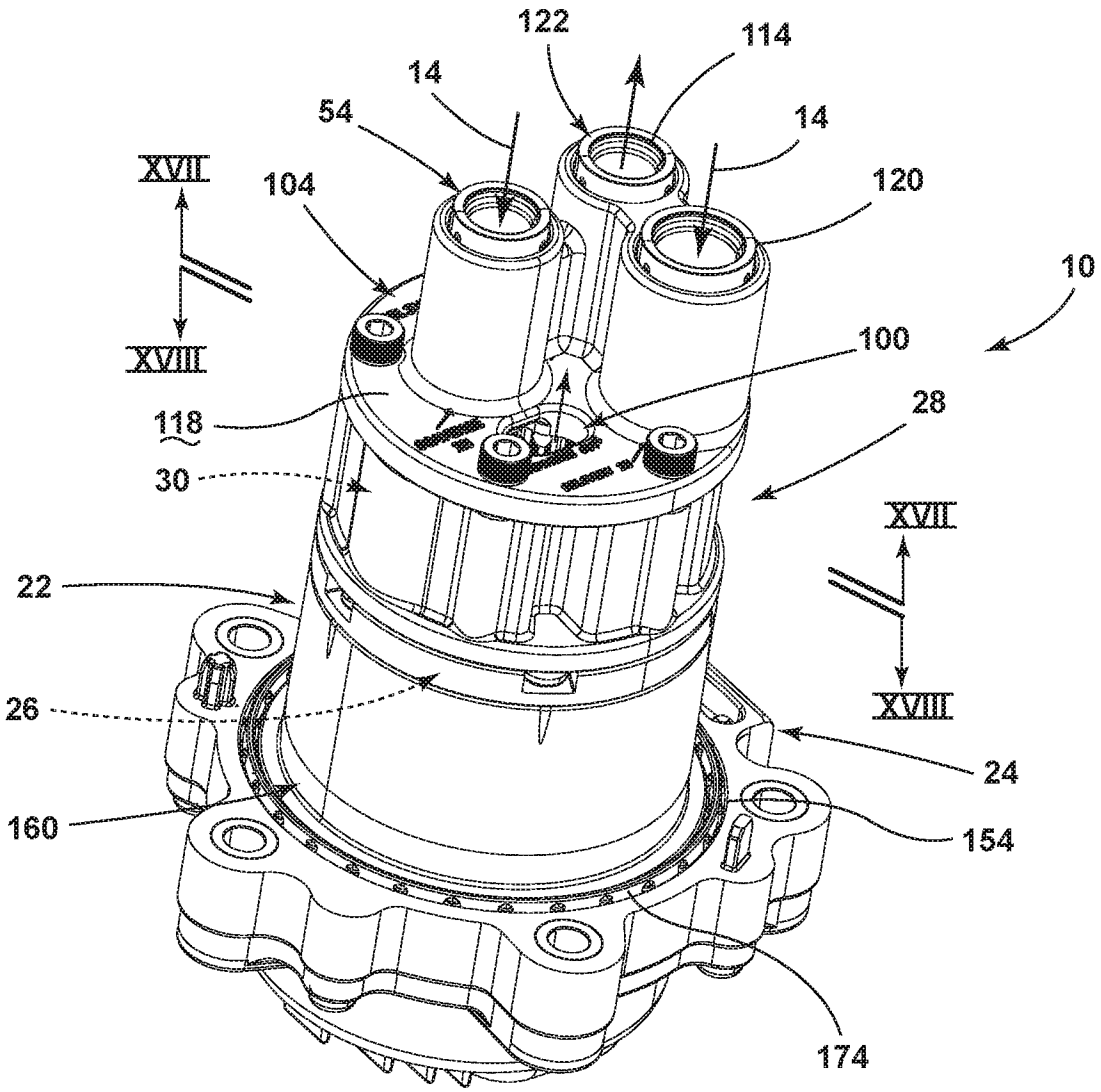
FIG. 12 is a side perspective view of an aspect of the fluid pump.
Figure 13:
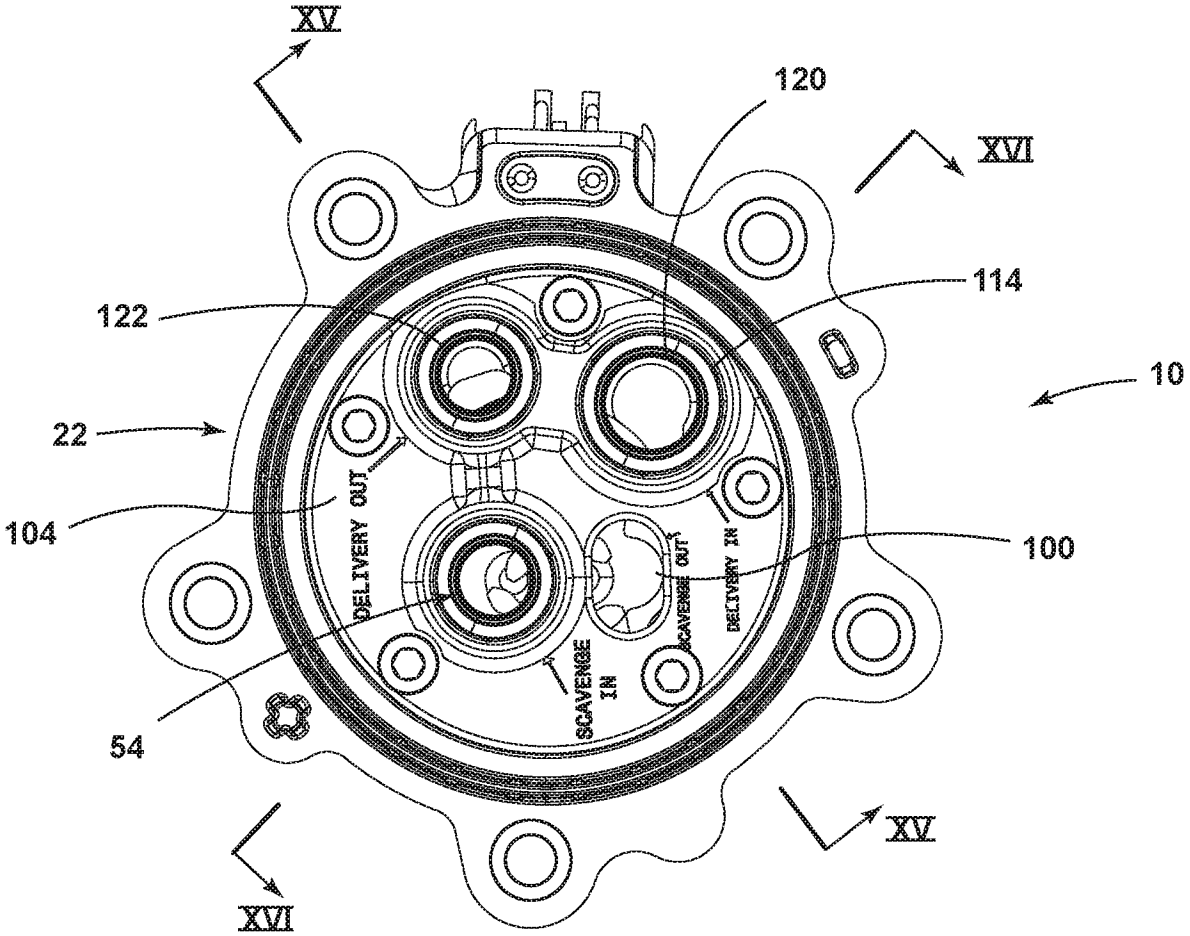
FIG. 13 is an end elevation view of the fluid pump of FIG. 12.
Figure 14:
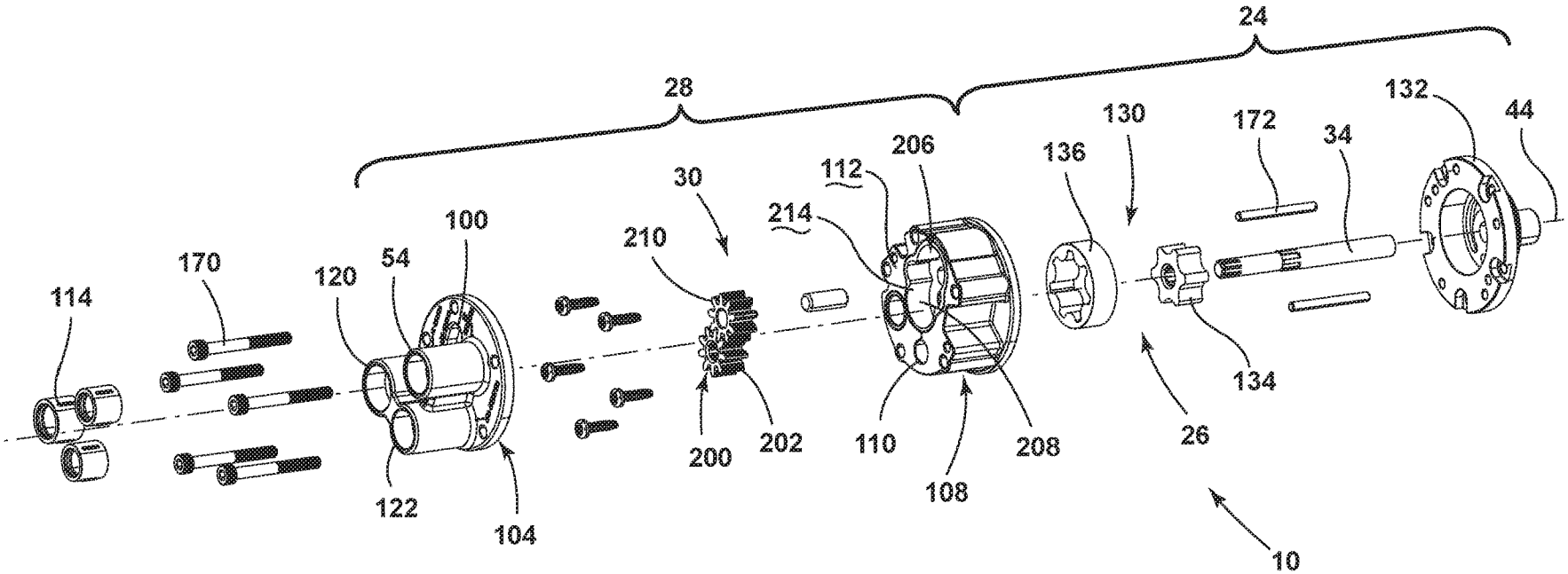
FIG. 14 is an exploded perspective view of the delivery and return portions of the fluid pump of FIG. 12.
Figure 15:
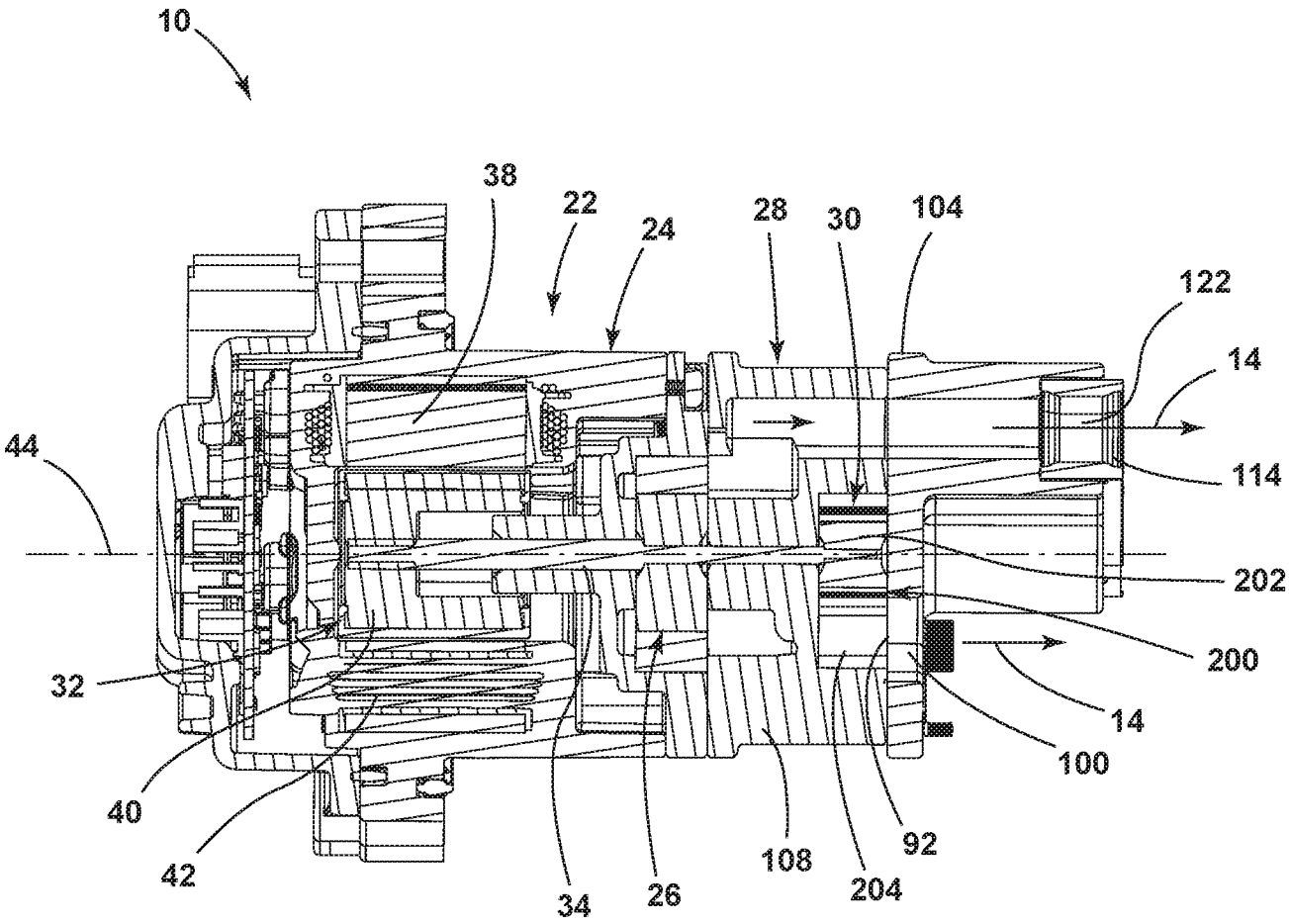
FIG. 15 is a cross-sectional view of the fluid pump of FIG. 13 taken along line XV-XV.
Figure 16:
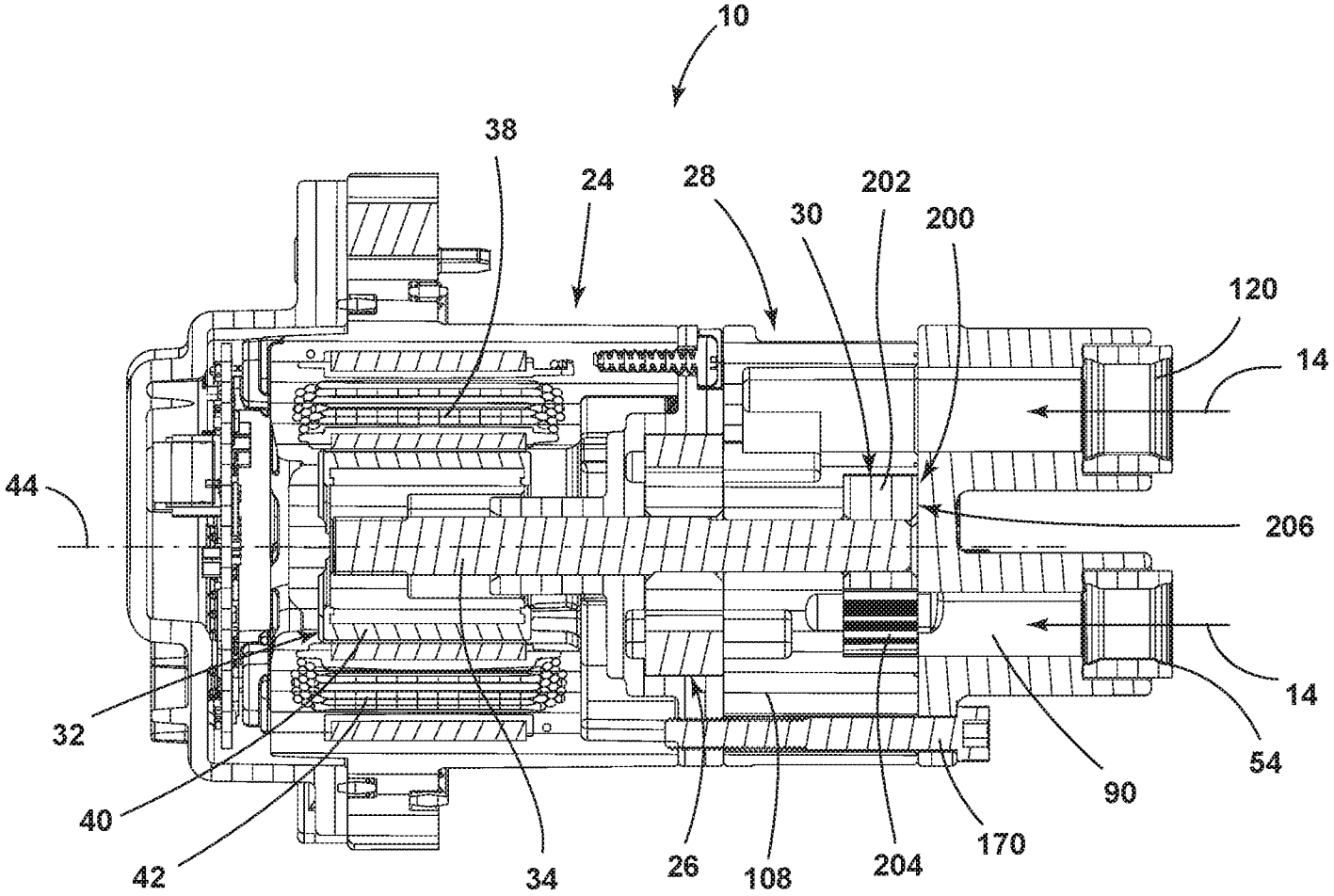
FIG. 16 is a cross-sectional view of the fluid pump of FIG. 13 taken along line XVI-XVI.
Figure 17:
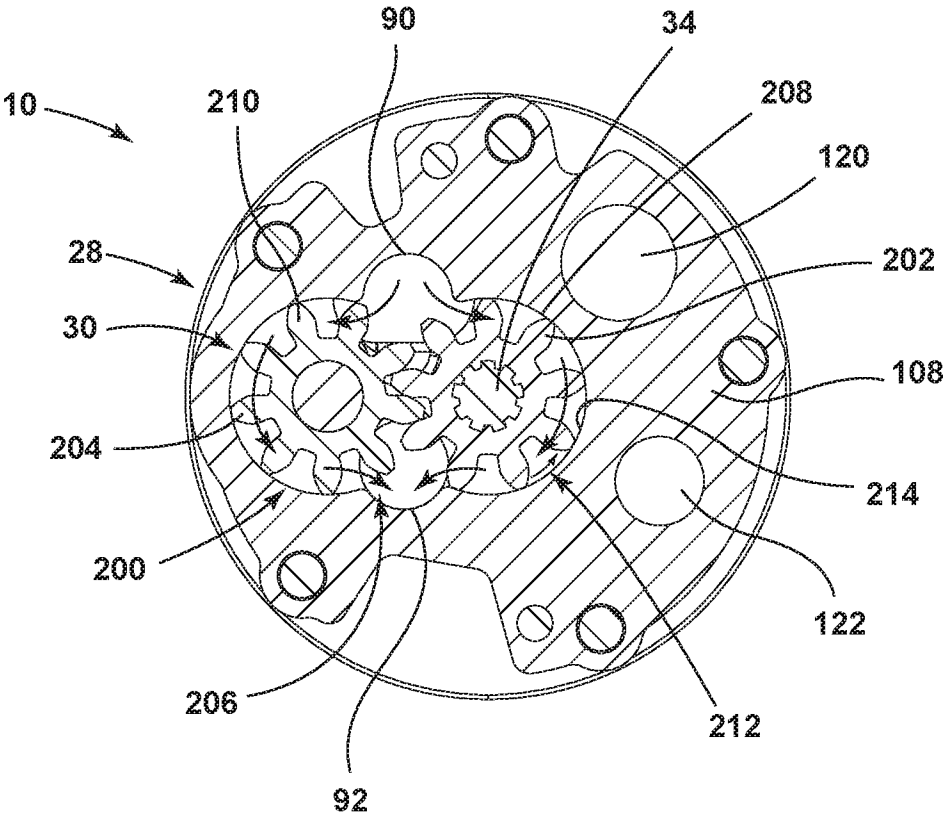
FIG. 17 is a cross-sectional view of the fluid pump of FIG. 12 taken along line XVII-XVII and showing an aspect of the return pump element.
Figure 18:
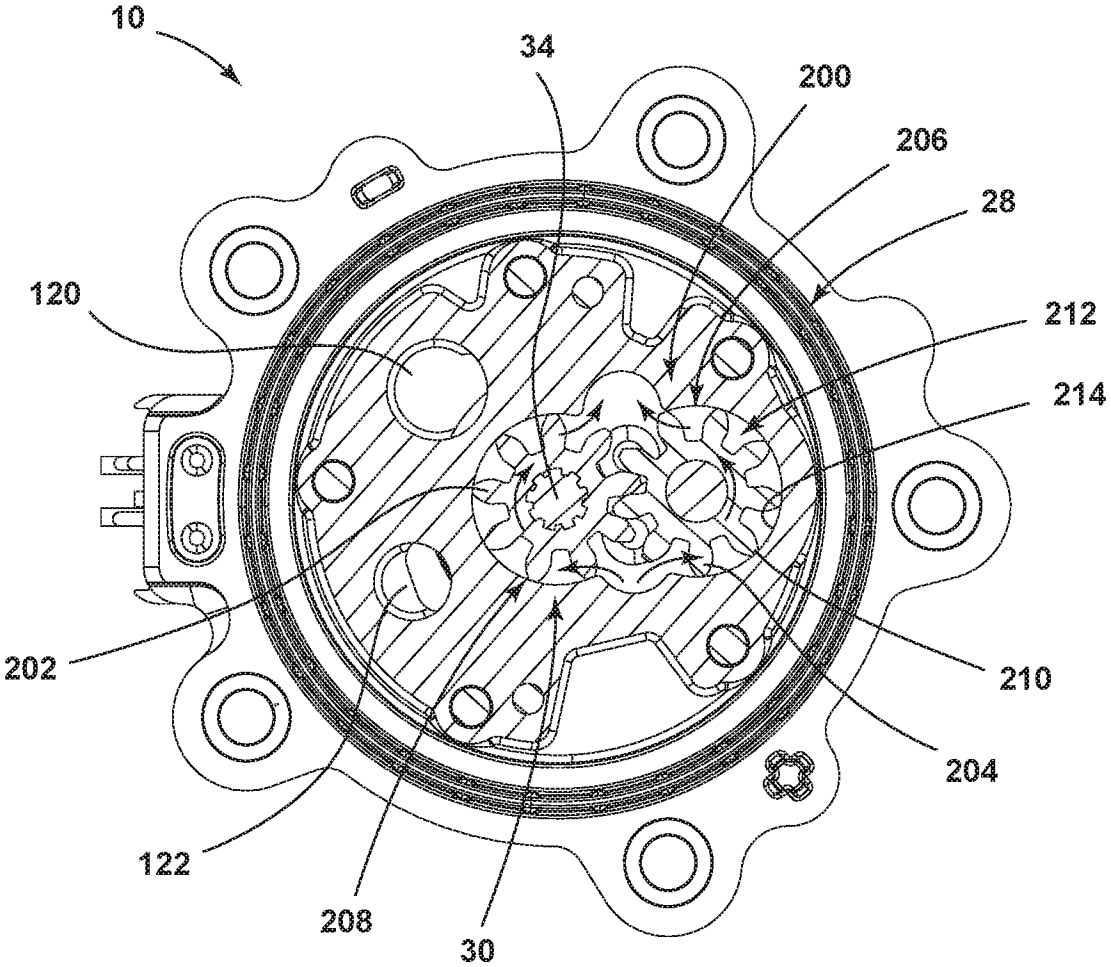
FIG. 18 is a cross-sectional view of the fluid pump of FIG. 12 taken along line XVIII-XVIII and showing an aspect of the return pump element.

Referring to FIGS. 6 and 7, the return pump element 30 can be positioned within the eccentric pump chamber 62 that is defined within the eccentric ring 106 for the fluid pump 10. The eccentric ring 106 is sandwiched between a pump cover 104 that includes each of the return inlets 54 and the return outlet 100. As discussed herein, fluid 14 is delivered from the sumps 16 to the return pump element 30 via the return inlets 54 and from the return pump element 30 toward the reservoir 18 via the return outlet 100, respectively. The porting housing 108 is positioned at an opposing side of the eccentric ring 106 from the pump cover 104. This porting housing 108 can include flow cavities 110 for assisting in the suction 72 and expulsion 76 of the fluid 14 relative to the vane pump 60 used within the eccentric pump chamber 62. The flow cavities 110 within the porting housing 108 can be defined within a return surface 112 of the porting housing 108 that faces the return pump element 30 and partially defines the eccentric pump chamber 62. Again, these flow cavities 110 can be used to assist in the drawing of fluid 14 through the inlet ports 90 as well as expelling the fluid 14 through the opposing outlet ports 92 and toward the reservoir 18.

Referring again to FIGS. 1-18, the delivery portion 24 of the fluid pump 10 includes the delivery pump element 26 that draws fluid 14 from the reservoir 18 and moves this fluid 14 through the delivery pump element 26 and toward the drive unit 12 having the sump assembly 15. Typically, the delivery portion 24 of the fluid pump 10 will include a single delivery inlet 120 that receives fluid 14 from the reservoir 18, and a single delivery outlet 122 that delivers the fluid 14 toward the drive unit 12.

As exemplified in FIGS. 1-11, the return portion 28 of the fluid pump 10 can include two dedicated scavenge or dedicated return inlets 54 that receive fluid 14 from each corresponding sump 16, respectively. This differing number of delivery inlets 120 within the delivery portion 24 and return inlets 54 within the return portion 28 is accounted for through the increased capacity of the return pump element 30 for drawing fluid 14 from at least one of the first and second sumps 50, 52 of the sump assembly 15. While the return portion 28 includes an increased capacity at the return pump element 30, the return pump element 30 will typically deliver an amount of fluid 14 that is less than a maximum flow capacity of the return pump element 30. Under typical operating conditions, the return pump element 30 will return an amount of fluid 14 that is similar, or substantially similar, to the capacity of the delivery pump element 26.

Additionally, in conditions where one of the first and second sumps 50, 52 are dry and all or substantially all of the fluid 14 is in the other of the first and second sumps 50, 52, the capacity of a single return inlet 54 of the return portion 28 has a capacity sufficient to match that of the delivery pump element 26 of the delivery portion 24. Typically, at a startup condition, the first and second sumps 50, 52 may each include a sufficient amount of fluid 14 that would allow the return portion 28 to operate at a maximum capacity.

By way of example, and not limitation, where a delivery pump element 26 includes a capacity of four cubic centimeters per revolution, it is contemplated that the return pump element 30 can include a capacity of eight cubic centimeters per revolution. Again, under typical operating conditions, the return pump element 30 will return the same or similar amount of fluid 14 to the reservoir 18 as that delivered by the delivery pump element 26 to the drive unit 12. As discussed herein, the increased capacity of the return fluid pump 10 accounts for situations where one of the first and second sumps 50, 52 is dry and the other of the first and second sumps 50, 52 may include a larger quantity of fluid 14. In such a condition, all of the fluid 14 returned to the reservoir 18, for a period of time, will be moved through only one of the return inlets 54, and only half of the operable pump cavities 70 of the return fluid pump 10 will produce the suction 72 and expulsion 76 of the fluid 14, until fluid 14 is allowed to collect within the other sump 16 of the first and second sumps 50, 52. Again, this configuration ensures that a consistent flow of fluid 14 is moved from one or both of the first and second sumps 50, 52 to the reservoir 18 and from the reservoir 18 to the drive unit 12 for providing adequate cooling and lubrication functions as desired.

Referring again to FIGS. 6-18, the delivery pump element 26 can be in the form of a generated rotor 130, sometimes referred to as a gerotor, that is seated within a pump body 132. The generated rotor 130 includes an inner gear 134 that rotates along the rotational axis 44 of the fluid pump 10. An outer eccentric cog 136 is placed within the pump body 132 in an offset configuration so that as the inner gear 134 rotates, a series of fluid chambers 138 are formed for delivering fluid 14 through the delivery portion 24 of the fluid pump 10. As the generated rotor 130 rotates, the various fluid chambers 138 operate to draw fluid 14 from the reservoir 18 and then push this fluid 14 towards the drive unit 12. When the fluid 14 is pushed towards the drive unit 12, the fluid 14 lubricates and cools various components and then falls toward the sump assembly 15 to be recirculated back to the fluid pump 10 using the return pump element 30 within the return portion 28 of the fluid pump 10.

Referring again to FIGS. 4-10, is certain embodiments of the fluid pump 10, a delivery inlet 120 is positioned within the porting housing 108 to one side of a gasket in the form of a porting seal 150. The delivery outlet 122 is also positioned within the porting housing 108, typically at an opposing side of the porting seal 150. Fluid 14 moves to the delivery portion 24 from the reservoir 18, enters the delivery inlet 120 within an outer wall 80 of the housing 22, moves through the generated rotor 130, and is delivered to the drive unit 12 via one or more delivery channels 152 defined within the outer wall 80 of the housing 22, such as within the porting housing 108. From the delivery channels 152, the fluid 14 exits the delivery outlet 122 that can also be defined within the outer wall 80 of the housing 22, such as within the porting housing 108.

In the exemplified configuration of FIGS. 1-18, the porting housing 108 defines a portion of each of the delivery portion 24 of the fluid pump 10 and the return portion 28 of the fluid pump 10, although alternative placement and configurations of the delivery and return portions 24, 28 are possible. Various gaskets, such as O-rings 154 and spring seals 114, are positioned at locations of the fluid pump 10 to maintain a separation of fluid 14 that moves through the delivery portion 24 and fluid 14 that moves through the return portion 28 of the fluid pump 10.

Referring again to FIGS. 1-18, the fluid pump 10 includes a motor portion or a motor housing 160 that includes an overmold that defines a motor cavity 168 that surrounds the stator 38 for the motor 32, and also allows for rotational operation of the rotor 40 relative to the stator 38. The motor housing 160 can include a printed circuit board (PCB) 162 and various electrical connections that can be utilized for delivering electrical power to the motor 32 and also for communicating data to and from components of the fluid pump 10 when in operation. It is contemplated that the motor 32 can be in the form of a variable speed motor 32 such that a controller 164 can be utilized for increasing or decreasing the speed of the motor 32 depending upon the fluid flow needs of the drive unit 12. In certain conditions, such as when a motor 32 is stopped, a transmission may not be in use such that fluid 14 does not need to be circulated through the transmission. At such instances, the fluid pump 10 can be stopped temporarily. A PCB 162 within the motor housing 160 can include various sensors 166 that can monitor fluid temperature, fluid flow rates, various conditions of the fluid 14 moving through the fluid pump 10, and other similar status information related to the fluid pump 10 and the fluid 14 moving therethrough.

Referring again to FIGS. 6-10, the various components that make up the housing 22 for certain aspects of the fluid pump 10 can include, but are not limited to, the pump cover 104, the eccentric ring 106, the porting housing 108, the pump body 132 and the motor housing 160. These components can be attached together via pump screws 170 that extend through these components that secure them to one another. Various alignment pins 172 can be disposed within the certain components of the housing 22 for aligning certain components together. In particular, the alignment of the porting housing 108 with respect to the generated rotor 130, the pump body 132, the eccentric ring 106 and the pump cover 104 are used to ensure a proper flow of the fluid 14 through each of the delivery portion 24 and the return portion 28 of the fluid pump 10. In addition to the various O-rings 154 that are used to separate certain portions of the fluid 14 within a delivery portion 24 and the return portion 28, the motor housing 160 can include a case seal 174 that is used to seal the fluid pump 10 with respect to a particular manifold 176 for the drive unit 12.

As discussed herein with respect to FIGS. 1-11, the fluid pump 10 utilizes the motor 32 and a controller 164 that is included within, or in communication with, the PCB 162 to simultaneously drive each of the delivery pump element 26 and the return pump element 30. The delivery pump element 26 and the return pump element 30 are integrated together within the housing 22 for the fluid pump 10 to provide a compact package for delivering fluid 14 to and from the reservoir 18 and the drive unit 12. As discussed herein, the sump assembly 15 for the drive unit 12 can include first and second sumps 50, 52 such that a dual fill or balanced vane pump 60 is used as the return pump element 30. This configuration utilizes two separate and dedicated return inlets 54 or dedicated scavenge inlets for ensuring that fluid 14 is delivered from one or both of the first and second sumps 50, 52 and to the reservoir 18. The return portion 28 of the fluid pump 10 combines these two return inlets 54 to a single hydraulic passage that is delivered through the return outlet 100 and toward the reservoir 18. The lubricating and cooling functions of the fluid pump 10 are then provided by the delivery pump element 26 that pulls the fluid 14 from the reservoir 18 and moves this fluid 14 through various cooling and/or lubrication circuits. As discussed herein, it is typically not known which of the plurality of sumps 16 may have fluid 14 disposed therein at any particular time. The use of the return pump element 30, as a scavenge pump, having the multiple dedicated scavenge or dedicated return inlets 54, is capable of providing a sufficient flow of fluid 14 from one or both of the first and second sumps 50, 52 into the reservoir 18. The use of the vane pump 60 as the return pump element 30 provides twice the pump displacement as the delivery pump element 26, thereby ensuring a consistent flow of fluid 14 through the hydraulic system 20.

According to various aspects of the device, the locations of the various inlets and outlets of the delivery and return portions 24, 28 can vary depending upon the exact design of the drive unit 12 and reservoir 18 that receives the fluid pump 10. In addition, the positioning of the delivery portion 24 and the return portion 28 can also be switched depending upon the configuration of the drive unit 12 and reservoir 18 within which the fluid pump 10 is disposed. In the various configurations, it is contemplated that a single motor 32 is used to drive each of the delivery pump element 26 and the return pump element 30 simultaneously. In addition, the configuration of the return portion 28 having two scavenge or return inlets 54 and the delivery portion 24 having a single delivery inlet 120 is a feature that is present within each configuration of the device. As discussed herein, the return portion 28 can include two return inlets 54 or more return inlets 54 depending upon the number of sumps 16 included within the drive unit 12. Where additional sumps 16 are included, additional return inlets 54 as well as additional return ports and outlet ports 92 can be included within the eccentric pump chamber 62 for the return pump element 30 of the return portion 28. Where a single sump 16 is included, a single return inlet 54 and a single outlet port 92 can be utilized.

Referring now to FIGS. 12-18, the fluid pump 10 can include the housing 22 having the motor portion or motor housing 160, the delivery portion 24 and the return portion 28. The motor 32 is disposed within the motor housing 160 and is operably coupled to the drive shaft 34 that extends from the motor 32 and through the delivery portion 24 and the return portion 28. The delivery pump element 26 is disposed within the delivery portion 24 and is coupled with the drive shaft 34. Similarly, the return pump element 30 is disposed within the return portion 28 and is also coupled with the drive shaft 34. Operation of the motor 32 drives the delivery pump element 26 and the return pump element 30 via the drive shaft 34. The delivery portion 24 and the delivery pump element 26 are configured to deliver fluid 14 from a reservoir 18 to the drive unit 12. The return portion 28 and the return pump element 30 are configured to deliver the fluid 14 from the sump assembly 15 of the drive unit 12 and to the reservoir 18. In certain aspects of the device, the return pump element 30 can be in the form of a gear pump 200 that includes a drive gear 202 that is coupled with the drive shaft 34. The gear pump 200 also includes an idler gear 204 that meshes with the drive gear 202.

Referring again to FIGS. 12-18, during operation of the motor 32, the drive shaft 34 operates each of the delivery pump element 26 and the return pump element 30. In the case of the gear pump 200, the drive shaft 34 rotates the drive gear 202 and the idler gear 204 within a pump chamber 206 having a generally lemniscate profile 208. As the drive gear 202 and the idler gear 204 rotate within the pump chamber 206, cogs 210 of the drive gear 202 and the idler gear 204 form a plurality of gear cavities 212 with the inside surface 214 of the pump chamber 206. In this manner, the individual gear cavities 212 deliver fluid 14 from the return inlet 54 that draws fluid from the sump 16. As the drive gear 202 and the idler gear 204 rotate within the pump chamber 206, the fluid 14 within the gear cavities 212 is moved along the inside surface 214 of the pump chamber 206 and to the outlet port 92 of the return outlet 100 to be delivered to the reservoir 18.

Referring again to FIGS. 12-18, according to the various aspects of the device, the delivery inlet 120 and the delivery outlet 122 can be positioned to extend from the delivery pump element 26 and through the pump cover 104. Accordingly, the delivery inlet 120, the delivery outlet 122, as well as the return inlet 54 and the return outlet 100 can each be positioned within the end surface 118 of the pump cover 104. To account for movement of the fluid 14 by the delivery pump element 26 and the return pump element 30 through the pump cover 104, the pump chamber 206 can be positioned in an offset configuration within the pump cover 104. This offset configuration of the pump chamber 206 also allows the drive gear 202 to be centrally positioned within the pump cover 104 to engage the drive shaft 34. The idler gear 204 is typically positioned in an offset orientation and to an opposite side of the pump cover 104 relative to the delivery inlet 120 and delivery outlet 122.

Referring again to FIGS. 1-18, the fluid pump 10 can include the motor portion or motor housing 160, the delivery pump element 26 and the return pump element 30. The drive shaft 34 extends from the motor 32 to each of the delivery pump element 26 and the return pump element 30. The motor 32, the drive shaft 34, the delivery pump element 26 and the return pump element 30 are all contained within the housing 22. Operation of the motor 32 is configured to simultaneously drive the delivery pump element 26 and the return pump element 30 via the drive shaft 34. The delivery pump element 26 is configured to deliver fluid 14 from the reservoir 18 and to the drive unit 12. The return pump element 30 is configured to deliver the fluid 14 from the sump assembly 15 of the drive unit 12 and to the reservoir 18 for later use. As described herein, the various configurations of the drive unit 12 and the fluid pump 10 can vary depending upon the design of the particular mechanism within which the fluid pump 10 is being positioned. Accordingly, the number of sumps 16 within the sump assembly 15 can vary, as well as the design of the return pump element 30.

According to various aspects of the device, the fluid pump 10 described herein can be incorporated within any one of various mechanisms. Such mechanisms can include, but are not limited to, vehicles, robotics, appliances, and other similar mechanical applications. Typically, the use of the fluid pump 10 described herein is used for providing fluids 14 that are related to the lubrication and/or cooling of the various mechanisms. These fluids 14 can include, but are not limited to, oils, coolants, water, and other similar fluids 14.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A fluid pump comprising:

a housing;

a delivery portion having a delivery pump element disposed within the housing, wherein the delivery pump element includes a delivery inlet and a delivery outlet;

a return portion having a return pump element disposed within the housing, wherein the return pump element includes a first return inlet, a second return inlet, and a return outlet;

a motor disposed within the housing that drives the delivery pump element and the return pump element via a drive shaft, wherein the delivery portion is configured to deliver fluid from a reservoir, through the delivery inlet and the delivery outlet and to a drive unit, and wherein the return portion is configured to deliver the fluid from a sump assembly having a first sump and a second sump of the drive unit, through the first return inlet and the second inlet, respectively, and the return outlet to the reservoir; and a pump cover, wherein the delivery inlet, the delivery outlet, the first return inlet, the second return inlet, and the return outlet deliver the fluid through the pump cover.

2. The fluid pump of claim 1, wherein operation of the motor simultaneously operates the delivery pump element and the return pump element to deliver the fluid between the reservoir, the drive unit and the sump assembly.

3. The fluid pump of claim 1, wherein the delivery pump element is a generated rotor.

4. The fluid pump of claim 1, wherein the return pump element is a vane pump that is positioned within an eccentric pump chamber, and wherein the eccentric pump chamber includes the first return inlet and the second return inlet that are in communication with the first sump and the second sump, respectively.

5. The fluid pump of claim 4, wherein the eccentric pump chamber includes opposing outlet ports that lead to the return outlet in communication with the reservoir, and wherein the vane pump includes a rotary member and a plurality of outwardly-biased fins that extend from the rotary member to a wall of the eccentric pump chamber to define a plurality of operable pump cavities.

6. The fluid pump of claim 1, wherein the delivery inlet and the delivery outlet are defined within an outer wall of the housing, and wherein the delivery inlet and the delivery outlet are separated by a gasket.

7. The fluid pump of claim 1, wherein the housing includes a motor housing that secures the motor within a motor cavity and also includes a printed circuit board having a controller that operates the motor.

8. The fluid pump of claim 1, wherein the housing includes a pump body and a porting housing that cooperate to define the delivery portion of the housing, and wherein the housing includes an eccentric ring and the pump cover that cooperate with the porting housing to define the return portion of the housing.

9. The fluid pump of claim 1, wherein the return pump element is a gear pump that includes a drive gear that meshes with an idler gear, and wherein the drive gear and the idler gear are positioned within a pump chamber having a generally lemniscate profile.

10. A fluid pump comprising:

a housing having a motor portion, a delivery portion and a return portion;

a motor disposed within the motor portion, the motor operably coupled to a drive shaft that extends from the motor and through the delivery portion and the return portion;

a delivery pump element disposed within the delivery portion and coupled with the drive shaft, wherein the delivery pump element includes a delivery inlet and a delivery outlet;

a return pump element disposed within the return portion of the housing and coupled with the drive shaft, wherein operation of the motor drives the delivery pump element and the return pump element via the drive shaft, wherein the delivery pump element is configured to deliver fluid from a reservoir to a drive unit, and wherein the return pump element is configured to deliver the fluid from a first sump and a second sump of the drive unit to the reservoir, and wherein the return pump element includes a return outlet configured to be in communication with a reservoir and a first return inlet and a second return inlet that are configured to be in respective communication with the first and second sumps; and a pump cover, wherein the delivery inlet, the delivery outlet, the first return inlet, the second return inlet, and the return outlet deliver the fluid through the pump cover.

11. The fluid pump of claim 10, wherein the return pump element is a vane pump that is positioned within an eccentric pump chamber, and wherein the eccentric pump chamber includes the first return inlet in communication with the first sump and the second return inlet in communication with the second sump, respectively.

12. The fluid pump of claim 11, wherein the vane pump includes a rotary member and a plurality of outwardly-biased fins that extend from the rotary member to a wall of the eccentric pump chamber to define a plurality of operable pump cavities.

13. The fluid pump of claim 10, wherein the delivery inlet and the delivery outlet are defined within an outer wall of the housing, and wherein the delivery inlet and the delivery outlet are separated by a gasket.

14. The fluid pump of claim 10, wherein the housing is positioned within a manifold, and wherein at least one gasket on an outer wall of the housing cooperates with the manifold to separate the delivery portion from the return portion, and wherein the at least one gasket includes spring seals that separate the first return inlet of the return portion, the second return inlet of the return portion and the return outlet of the return portion.

15. A fluid pump comprising:

a motor portion, a delivery pump element and a return pump element;

a drive shaft that extends from the motor to each of the delivery pump element and the return pump element, wherein the motor, the drive shaft, the delivery pump element and the return pump element are contained within a housing, wherein operation of the motor simultaneously drives the delivery pump element and the return pump element via the drive shaft;

the delivery pump element is configured to deliver fluid from a reservoir to a drive unit;

the return pump element is configured to deliver the fluid from a sump assembly of the drive unit to the reservoir;

the housing includes a porting housing that defines a portion of each of the delivery pump element of the fluid pump and the return pump element of the fluid pump; and the porting housing partially defines a delivery inlet and a delivery outlet of the delivery pump element and partially defines a first return inlet, a second return inlet, and a return outlet of the return pump element.

16. The fluid pump of claim 15, wherein the return pump element is a gear pump that includes a drive gear that meshes with an idler gear, wherein the drive gear and the idler gear are positioned within a pump chamber having a generally lemniscate profile.

17. The fluid pump of claim 16, wherein the housing includes a pump cover that partially defines the return pump element.

18. The fluid pump of claim 17, wherein the return pump element and the delivery pump element each deliver the fluid through the pump cover.

19. The fluid pump of claim 18, wherein the fluid is configured to be delivered through the delivery inlet, the delivery outlet, the first return inlet, the second return inlet, and the return outlet via the pump cover.

20. The fluid pump of claim 15, wherein the porting housing is a unitary member.

* * * * *